US005271610A

United States Patent [19]

Klotz

[11] Patent Number: 5,271,610

[45] Date of Patent: Dec. 21, 1993

[54] SKIDRAIL

[76] Inventor: E. John Klotz, Rte. 1, Box 39, East Bernard, Tex. 77435

[21] Appl. No.: 896,111

[22] Filed: Jun. 9, 1992

Related U.S. Application Data

[63] Continuation-in-part of Ser. No. 710,699, Jun. 5, 1991, abandoned.

[51] Int. Cl.[5] ..... F27D 5/00

[52] U.S. Cl. ..... 266/274; 432/234

[58] Field of Search ..... 266/274; 432/234, 235, 432/236

[56] References Cited

U.S. PATENT DOCUMENTS

| | | | |
|---|---|---|---|
| 3,304,070 | 2/1967 | Jones | 266/274 |
| 3,687,427 | 8/1972 | Mori et al. | 432/234 |
| 3,706,448 | 12/1972 | Salter et al. | 266/274 |
| 4,609,347 | 9/1986 | Yamashita et al. | 432/234 |
| 4,900,248 | 2/1990 | Terai et al. | 432/234 |

*Primary Examiner*—Scott Kastler
*Attorney, Agent, or Firm*—Harrison & Egbert

[57] ABSTRACT

A skidrail system for a reheat furnace including a first skidrail extending within the reheat furnace, a second skidrail extending within the reheat furnace in a skewed relationship with the first skidrail, a plurality of pipe members extending upwardly from the first and second skidrails, and a skid button positioned on an end of each of the pipe members opposite the first and second skidrails. The pipe members have an interior in fluid communication with an interior of the first and second skidrails. The skid button supports a product thereon. A fluid circulation system is positioned in the first and second skidrails and in the plurality of pipe members. This fluid circulation system delivers a cooling fluid in heat exchange relationship with the pipe members. The skid button is supported at least four inches above the first and second skidrail.

20 Claims, 5 Drawing Sheets

SKIDRAIL

RELATED APPLICATIONS

The present application is a continuation-in-part of U.S. patent application Ser. No. 07/710,699, filed on Jun. 5, 1991, and entitled "SKID SYSTEM FOR REHEAT FURNACES", now abandoned.

TECHNICAL FIELD

The present invention relates to skidrails or support rails for reheat furnaces. More particularly, the present invention relates to the button assemblies.

BACKGROUND ART

Reheat furnaces are used to heat workpieces prior to being introduced into subsequent processing such as rolling into sheet material. The uniformity of such heating of the workpieces has a substantial effect on the end product (i.e., the sheet material) as well as influencing the reheat furnace thermal efficiency. Such metallurgical furnaces include walking beam types. In the walking beam type of furnace, multiple support rails extend for the length of the furnace and support the workpieces as they are being conveyed through the furnace by the moving (walking) beams.

Three separate heat transfer effects of this walking beam type furnace and support rail configuration limit the heating efficiency and temperature uniformity of the heated workpieces. The reduced heating effects are characterized as "cold spots" or localized cooler regions within the heated workpiece having distinctly different temperatures with locations corresponding to the respective support rail positions. The first heat transfer effect is due to the close proximity of the support rails to the workpiece. This proximity produces a shadow effect whereby the support rails block radiation or shade the workpiece from the heat source of the furnace. A second heat transfer effect is that rails tend to cool the workpieces by conduction in response to direct contact of the workpiece with the skid buttons or support elements affixed to the top of the support rail. The support rail is typically liquid cooled and has a temperature which is cooler than that of the skid buttons or support elements. The third heat transfer effect is that the rails tend to cool the workpieces by secondary radiation heat exchange occurring between the cooler top surface of the liquid cooled rail interacting with the bottom of the workpiece.

Efforts have been made in the past to increase heating uniformity and to minimize cold spots by adding insulation to the support rails. U.S. Pat. Nos. 4,095,937 and 4,228,826 show such support rails. Support rail insulation is widely employed within the industry to counteract the localized workpiece cooling by secondary radiation exchange with the liquid cooled support rails. Other attempts to solve this problem are disclosed in U.S. Pat. Nos. 4,427,187 and 4,368,038 which involve various "hot rider tiles", "skid buttons", or support elements which are attached or otherwise mounted directly to the support rails. These prior inventions represent the current state of the art and employ high temperature resistant (ceramic and/or alloy) materials to provide a suitable high temperature wear surface or support element with sufficient thickness and height to elevate the workpiece above the support rails and reduce the shadow effect.

The use of the state of the art walking beam reheat furnace support rails and support elements (skid buttons) persists as previously described, and continues to suffer from reduced heating efficiency and poor temperature uniformity. The history and use of these conventional designs supports particular notions concerning furnace heat transfer effects. Skid system engineers and designers have long understood the radiation viewfactor benefits and have attempted to achieve practical elevated skid button designs so as to distance the workpiece from the necessary, but detrimental, underlying liquid cooled support rails. Using such conventional design guidelines, high temperature alloy skid button materials are used which have demonstrated practical height limits of three to four inches (75–100 mm) when operated continuously within a 2,400° F. (1315° C.) reheat furnace. Above the practical height limit these components soon fail in service due to heat-checking, sigma phase embrittlement, plastic deformation and general overheating as the temperature dependent physical material strength limits are repeatedly reached and exceeded by actual furnace operation and service. To achieve practical and durable skid buttons, U.S. Pat. No. 4,293,299 addressed these physical material limits with direct additional skid button cooling by submerging the root or bottom of the support button within the liquid cooled stream of the main support rail. This development advocated the additional skid button cooling to reduce material operating temperatures. However, the intent of this patent was only to enhance the durability and longevity of the skid button. Normally, skid buttons are operated continuously in the harsh reheat furnace environment. The prior art has noticably ignored the separate direct cooling of an elevated skid button.

U.S. Pat. No. 4,609,347 proposed high temperature refractory skid button materials. While still under development, ceramic and admixture-type skid buttons of this height generally fail prematurely due to the inherently low compressive and mechanical strength of ceramics when submitted to a typical industrial reheat furnace service.

The foregoing is offered to confirm the previous reluctance of furnace skid system designers to significantly elevate workpieces above the support rails. The direct cooling of elevated skid buttons has previously been ignored because of the perceived detrimental effect caused by localized workpiece conduction cooling. If the skid buttons were cooled, it was typically reasoned that any product placed on top of these cooled skid buttons would also be cooled by conduction. This was considered to be against the desired purpose of the reheat furnace. As such, no attempts have been made, in the past, to directly cool elevated skid buttons. Typical skid buttons are of a height much less than four inches and are made of solid material. It has been the typical goal, in the prior art, to have the skid buttons retain as much heat as possible.

Through exhaustive heat transfer calculations of the heating process, the present inventor has identified, quantified and evaluated the pertinent design criteria governing the furnace heating efficiency and final workpiece temperature uniformity. It was found that elevating skid buttons significantly separate or distance the workpiece from the support rails and thereby greatly enhance workpiece heating. Additional beneficial radiation heating from the hot furnace (the first heat transfer effect identified hereinabove), and re-radiation from the hotter rails (previously identified as the third heat transfer effect) have been found to overcome, and indeed, far outweigh the detrimental conduction cooling effect (identified as the second heat transfer effect hereinabove) incurred by direct workpiece contact with the individually cooled elevated skid buttons.

It is an object of the present invention to provide increased heating efficiency and workpiece temperature uniformity as produced by walking beam type reheat furnaces.

It is another object of this invention to suitably and practically support workpieces a significant distance above the skidrails or support rails to minimize detrimental shadow effects and increase radiation heating from the hot furnace to the workpiece.

It is another object of the present invention to elevate workpieces a significant distance above the support rails to allow heating of these rails and to promote additional workpiece heating by re-radiation at these locations.

It is another object of the present invention to effectively support workpieces a significant distance above the support rails by means of individually cooled extensions from the support rails.

It is still a further object of the present invention to reduce the conduction effects by skewing the workpiece support along the support rails.

These and other objects and advantages of the present invention will become apparent from a reading of the attached specification and appended claims.

SUMMARY OF THE INVENTION

The present invention is a skidrail for a reheat furnace that comprises a plurality of support elements extending within the reheat furnace, a pipe arrangement extending upwardly from the support elements and attached to the support elements, and a fluid circulation system contained within the pipe arrangement so as to deliver fluid in heat exchange relationship with the pipe arrangement. The pipe arrangement has a surface for supporting a product thereon within the reheat furnace. Each of the support elements is a tubular member that extends longitudinally through the reheat furnace. The tubular member has a fluid pathway therein for the passage of a cooling fluid. The pipe arrangement is rigidly affixed to the tubular member and extends vertically upwardly therefrom. The fluid circulation system is in communication with the fluid pathway of the tubular member such that the cooling fluid passes in heat exchange relationship with the pipe arrangement. A supply pipe is positioned within the fluid pathway. The fluid circulation system includes an extender pipe cooling tube which extends interior of the pipe arrangement. This extender pipe cooling tube is in fluid communication with the supply pipe. The supply pipe delivers the cooling fluid to this extender pipe cooling tube. An annular passageway is disposed between the extender pipe cooling tube and the pipe arrangement. This extender pipe cooling tube opens within each of the pipes so as to deliver cooling fluid into the annular passageway.

The pipe arrangement comprises a pipe member which is affixed to at least one of the support elements, and a cap which is fastened to an end of the pipe member opposite the support elements. The cap serves to close an interior of the pipe member. A skid button is fastened to and extends above the pipe member. The skid button is of a heat resistive material for supporting the product thereon within the reheat furnace. An insulation sleeve also extends around the exterior of the pipe member. This insulation sleeve is also of a heat resistive material.

Ideally, the pipe member will have a length of greater than four inches. The cap is positioned in fluid-tight relationship to an end of the pipe member so as to contain the cooling fluid within the pipe member. The skid button generally covers the exterior of the cap.

The pipe arrangement is generally skewed along the plurality of support elements in such a way that the surface for supporting the product is in contact with different areas along a surface of the product.

The present invention is also an improved skid button assembly for the skidrail of a reheat furnace which includes the pipe member, a skid button fastened to the top of the pipe member, and the fluid circulation system. The skid button is supported above the support rail of the skid system by a distance of greater than four inches.

DESCRIPTION OF THE INVENTION

The present invention is an improved skidrail which represents an effective and suitable design so as to adequately elevate, support and convey product (typically steel slabs) through high temperature industrial reheat furnaces operating at approximately 2400° F. while the product is heated from ambient for charging temperature to a suitable roll forming temperature of approximately 2200° F.

Figure 1:
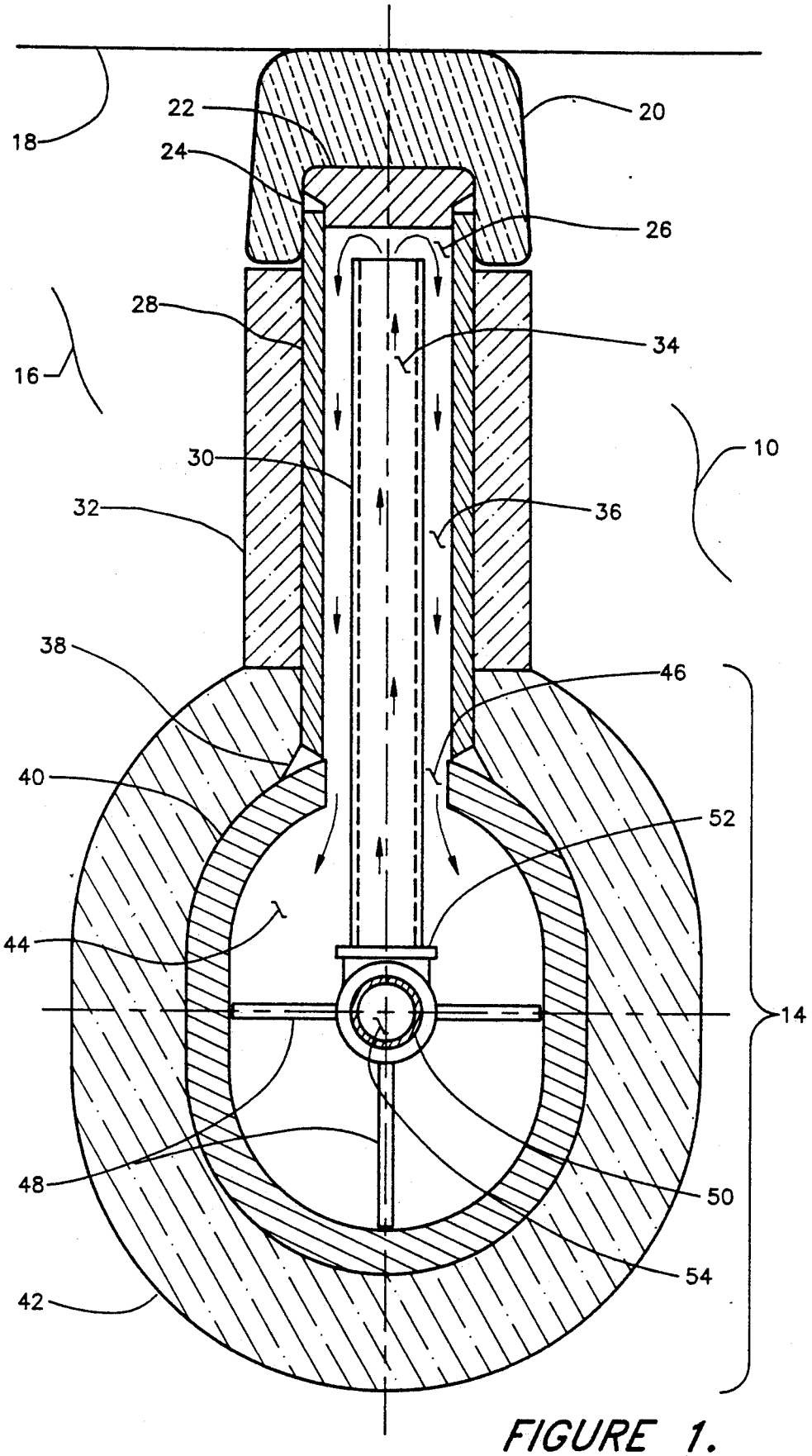
FIG. 1 is a cross-sectional view of the improved skidrail assembly in accordance with the preferred embodiment of the present invention.

Referring to FIG. 1, there is shown the basic components of the improved skidrail of the present invention. FIG. 1 shows at 10 the preferred embodiment of the present invention. Many suitable alternatives of the configuration illustrated in FIG. 1 are possible within the confines of the present invention.

As illustrated in FIG. 1, the relatively massive product of the steel slabs is supported and conveyed within a furnace on a water-cooled skidrail 14. A cross-section of such a water-cooled improved skidrail is illustrated in FIG. 1. Usually, steel slabs have a bottom surface 18 which is heated by radiant and convective heat transfer from the furnace environment 16.

The water-cooled improved skidrail 14 typically consists of a tubular steel support pipe 40 which runs the longitudinal length of 100 to 150 feet through the furnace. Each skidrail or support rail is water or steam cooled by adequate coolant flow through the internal annular area 44. The skidrail is also protected from the hot furnace environment 16 by an external refractory insulation cover layer 42.

The present invention of the improved skidrail, as described by the preferred embodiment, includes additional coolant service 54 to suitably cool the elevated skid button 20. The design of FIG. 1 shows a conventional water-cooled longitudinal pipe 40 provided with a smaller extender pipe 28. Extender pipe 28 is welded to the support pipe 40. Watertight and structurally solid welds 38 are used to attach extender pipe 28 to the longitudinal pipe 40. The extender pipe 28 provides the principal function of this invention by elevating the support button 20 a desired distance above the longitudinal support pipe 40 while providing mechanical support and the required annular conduits 36 for the additional extender pipe and button coolant flows. In the preferred embodiment of the present invention, the extender pipe will have a length so as to elevate the top surface of the skid button 20 a distance of greater than four inches above the main support skid 40.

The extender pipe 28 is further provided with external protection from the hot furnace environment 16 by means of an insulation sleeve 32. Sleeve 32 is generally circular in shape with a hollow interior to fit snugly around the extender pipe 28. The length of sleeve 32 is selected to virtually cover all exposed portions of the extender pipe 28 between the support pipe insulation 42 and the skid button 20. Sleeve 32 is made of any refractory material, such as fireclay or alumina compounds, suitably selected for high temperature compatibility with the furnace atmosphere and the thermal insulating properties.

It is intended that the outer sleeve surface in contact with the hot furnace gases, operates at or near the furnace temperature, while the inner sleeve surface next to the extender pipe 28, operates at a much lower temperature. Properly selected insulating refractory materials used for the sleeve 32 will exhibit a temperature difference or gradient due to their inherent relatively low thermal conductivity.

Extender pipe 28 is furnished with an extender pipe cap 22 which is attached, in fluid-tight connection, to the extender pipe 28 by weld 24. This cap 22 serves a dual purpose. First, cap 22 provides adequate mechanical support for the skid button 20. The cap 22 also forms a water-tight seal of the extender pipe coolant flow 26. The combined system of the longitudinal support pipe 40, the extender pipe 28, the cap 22, and the button 20 represents the structural and functional elements for the improved skidrail within the confines of furnace 16.

Skid button 20 is the final interface between the underlying skidrail and the heated product. Button 20 is included in the illustration of FIG. 1, but is not absolutely necessary in the present invention. As an alternative, the extender pipe 28 may simply be lengthened to allow the product 18 to be supported directly on the extender pipe cap 22. Such "button-less" designs may be entirely satisfactory for applications where operating conditions, mainly temperature, permit, such as cooler regions of the furnace. When employed, skid button 20 is cast or otherwise manufactured using any suitable durable material. The skid button 20 generally covers the cap 22 and is juxtaposed against the top of the insulation sleeve 32. The button materials may be high temperature resistant steel alloys which include high percentages of nickel, chromium, cobalt, and additions of tungsten, molybdenum, and niobium to achieve sufficient high temperature strength and wear resistance as needed for the required service. As used, button 20 is affixed to the extender pipe 28 by welding or by mechanical cleat arrangements. The button 20 may also be attached by using its own weight or by a locking configuration integral to its shape. A variety of other attachment methods may be used in the present invention.

Individual coolants flow to each elevated skid button is further illustrated in FIG. 1. Many similar coolant piping arrangements are possible within the scope of the present invention. The present invention should not be limited by the preferred piping arrangement illustrated herein.

FIG. 1 depicts a supply pipe 50 centrally located within the interior of support pipe 40. Supply pipe 50 is further maintained in position within the support pipe 40 by means of one or more mechanical supports 48 serving to stabilize and maintain supply pipe 50 at its proper location.

At each appropriate location corresponding to the elevated skid buttons, the supply pipe 50 is provided with a branch "T" fitting 52 so as to allow separate upward cooling fluid to each skid button. Branch "T" fitting 52 is connected to extender pipe cooling tube 30. B supplying sufficient cooling fluid flow and pressure to pipe 50, through separate pumping means (not shown), the piping arrangement described above provides individual coolant fluid to each elevated skid button element along the length of the support pipe 40 and the supply pipe 50.

Cooling fluid flows through the annular opening 54 of supply pipe 50 and is suitably diverted by pressure effects upwardly through internal flow area 34 of extender pipe cooling tube 30. Coolant flow then strikes the bottom surface of extender pipe cap 22 to impart convective cooling to this element and subsequent conductive cooling to the elevated skid button 20 by contact conductance. Coolant flow further proceeds downward through annular area 36 between the interior surface of extender pipe 28 and the outside of cooling tube 30. This downward coolant flow serves to cool extender pipe 28 by convective means. The coolant flow next passes through annular opening 46 in the support pipe 40 and combines with the support pipe coolant stream flowing through annular area 44.

By the above-stated means of extender pipes 28, suitable separate coolant supply line 50, extender pipe cooling tubes 30 and the ensuing coolant flows, the skid buttons supporting the workpiece are feasibly and effectively elevated to significant, if not extreme, distances above the main support pipes as described by the present invention.

Figure 2:
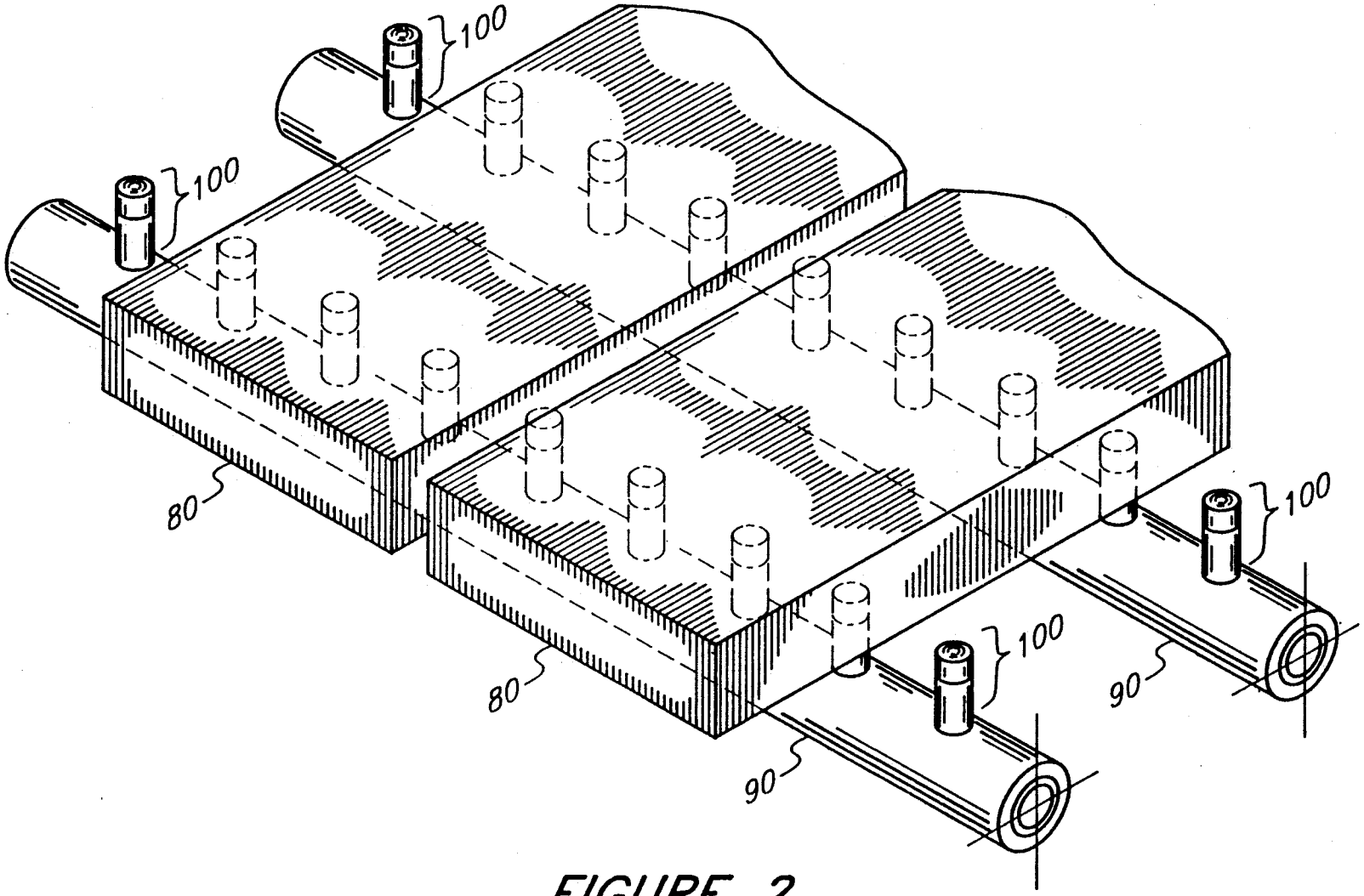
FIG. 2 is a plan view showing the improved skidrail and supporting structure as supporting a product within a reheat furnace.

FIG. 2 illustrates a practical configuration of the present invention of the improved skidrail for a walking beam type reheat furnace. The improved skidrail is easily employed in walking beam type furnaces.

The preferred embodiment of the present invention utilizes numerous elevated skid button assemblies 100, as shown in FIG. 2, whose details have been described above and are shown in particular, in FIG. 1. Skid button assemblies 100 are intermittently located and suitably affixed to support pipes 90 to form the liquid-cooled workpiece support system within the interior of furnace 70. Individual elevated skid button assemblies are separated from each other along the longitudinal length of the support pipes 90. This separation distance is ideally the maximum possible to allow radiation heating of the workpiece 80 from the hot furnace 70. Contrary to such maximum skid button spacings desired for heating purposes, a functional design must also provide adequate workpiece support. A compromise spacing is thus indicated which balances improved workpiece heating against required workpiece size and support requirements.

Figure 5:
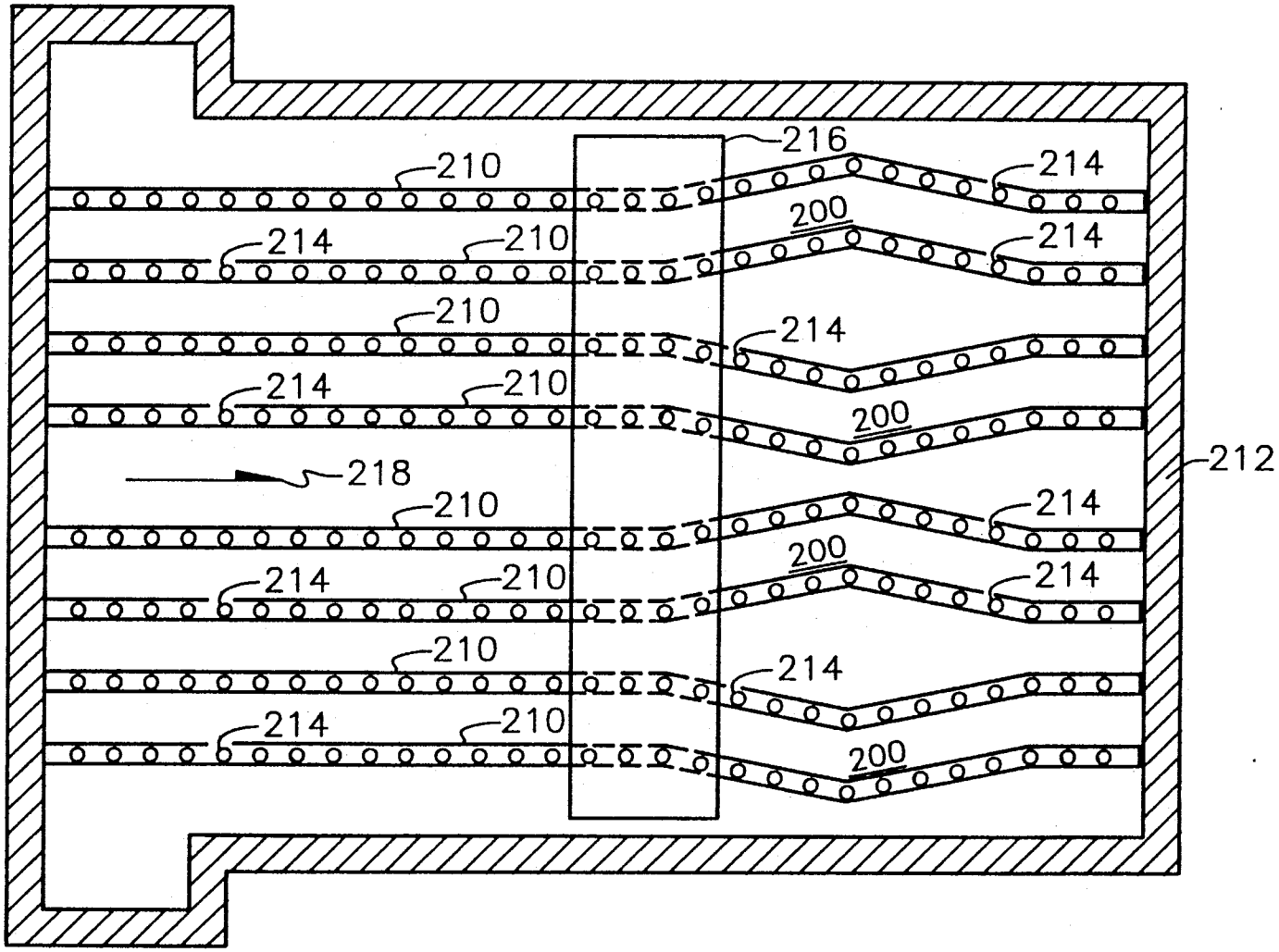
FIG. 5 is a top diagrammatic view of a reheat furnace showing, in particular, the skewed nature of the improved skidrail.

With reference to FIG. 2, it can be seen that each of the elevated skid buttons supports the product 80 in the desired position. However, FIG. 5 illustrates an alternative, and perhaps preferred, embodiment in which the skidrails 210 are skewed relatively to each other. In FIG. 5, it can be seen that the furnace 200 has a plurality of skidrails 210 formed therein. The environment around the skidrails 210 is greatly heated by the action of furnace 200. The refractory walls 212 surround the skidrail 210 so as to provide the confining environment of the furnace. Each of the skidrails 210 includes elevated skid button assemblies 214. These elevated skid button assemblies 214 extend upwardly from the support pipes in the manner shown in FIG. 2. The product 216 is supported by these elevated skid button assemblies 214. In the "walking beam" type of furnace, the product 216 will move in the direction indicated by arrow 218.

It can be seen that the skidrail 210 are generally skewed in area 220. After experimentation, it has been found that the skewing of the skidrails 210 enhances the ability to furnish a product 216 having consistent temperatures throughout. If there is any conduction effect from the individual skid button assemblies 214, then such conduction effect is transmitted to the product 216 at separate locations along the surface of the product 216. For example, in the position indicated in FIG. 5, the elevated skid buttons will have a conduction effect on the product 216 in one location. As the product 216 moves onward, the conduction effect will generally move in the direction of the skidrails 210. As a result, excessive conduction effects affecting a single line area along the bottom surface of the product 216 is properly avoided. In keeping with the present invention, the skidrails may be skewed or offset as desired. This skewing effect greatly enhances the capabilities of the present invention.

The present invention of the improved skidrail provides for increased heating to the underside of supported (product) steel slabs as well as by inducing greater temperature uniformity within the final reheated steel slab itself. Higher heating rates and improved thermal uniformity are desirous to furnace operators within the hot strip steel rolling industry for improving production throughput and final strip quality.

The improved skidrail design of the present invention provides these benefits by establishing a means and suitable design to continuously support and convey thick (eight to fourteen inches) steel slabs weighing twenty to forty tons each to a modern industrial walking beam slab reheat furnace where the slab product is heated (or reheated) to approximately 2200° F. in a 2400° F. operating furnace. The improved skidrail design principle was developed by exhaustive radiation heat transfer calculations of distancing and thereby reducing the cooling effects (on the steel slab product) of the water cooled skidrail. The improved skidrail design allows the bottom of the steel slab to be totally heated by raising it approximately eight to twenty inches above the main longitudinal support pipe supporting the product load within the slab reheat furnace. This elevation advantage exhibits several heating benefits as are discussed hereinafter. The benefits are derived from the appropriate elevation of the steel slab above the water-cooled skidrail and underlying structural system.

To demonstrate evidence of improved heating on behalf of the improved skidrail, the following are assumed and fully confirmed within the slab reheating art. Within high temperature (steel slab) reheat furnaces operating at about 2400° F., heating is almost exclusively radiation heat transfer from the hot furnace to the cooler steel slab product. It is necessarily affected by the well-established "radiation viewfactor" (F) contained in the imperical Stefan-Boltzman equation governing radiation heat exchange between objects at differing temperatures. While the complete investigation and evaluation of such calculations within the complete furnace system may become considerably involved requiring elaborate computer calculations for exact determination, these principals simply illustrate that radiation heat transfer is "viewangle" dependent just as standing in the shade or out of the "view" of the sun is cooler than standing in direct sunlight.

To this end, it is readily demonstrated and shown by simple geometry that increasing the viewangle and subsequent heating of steel slabs is increased and improved by elevating the (product) steel slab approximately twenty inches above the water cooled skidrail or support pipe. Upon further examination of the improved skidrail design, several overall heating benefits are realized, as are described in the following.

Figure 3:
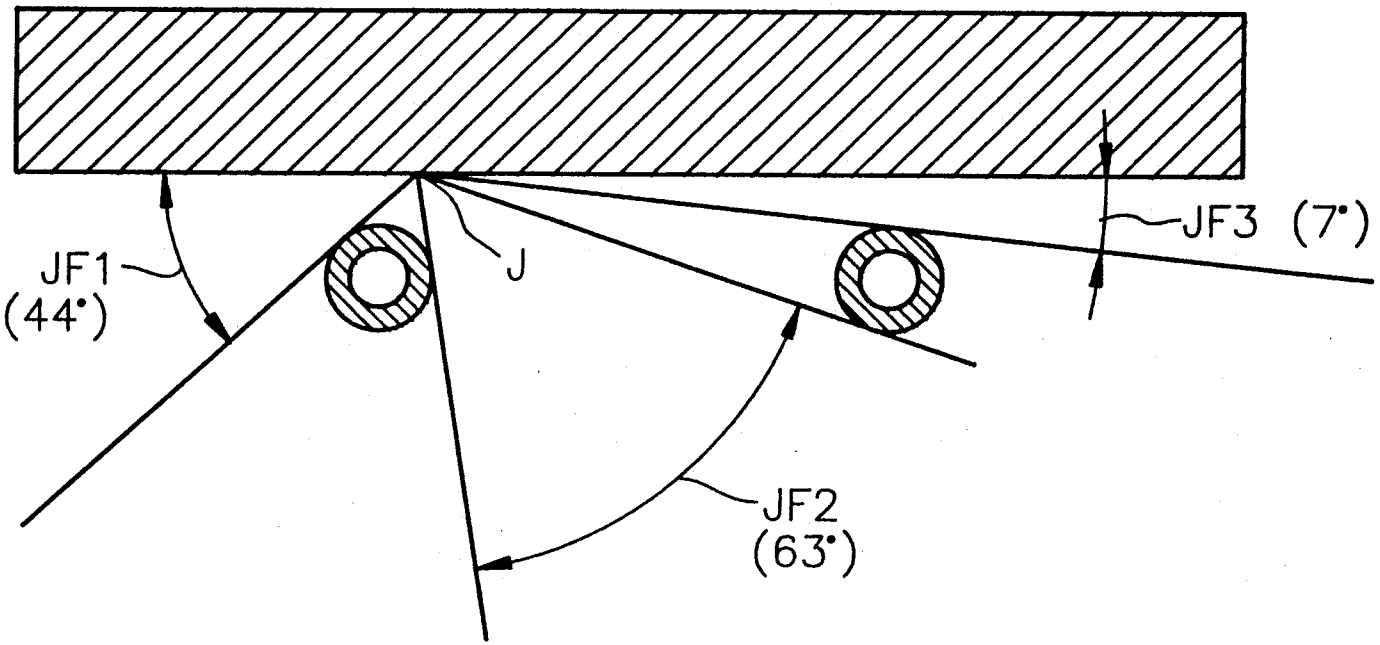
PRIOR ART FIGURE 3.
FIG. 3 is a diagram, illustrating the heat transfer effects of the prior art arrangement of skidrail assemblies.
Figure 4:
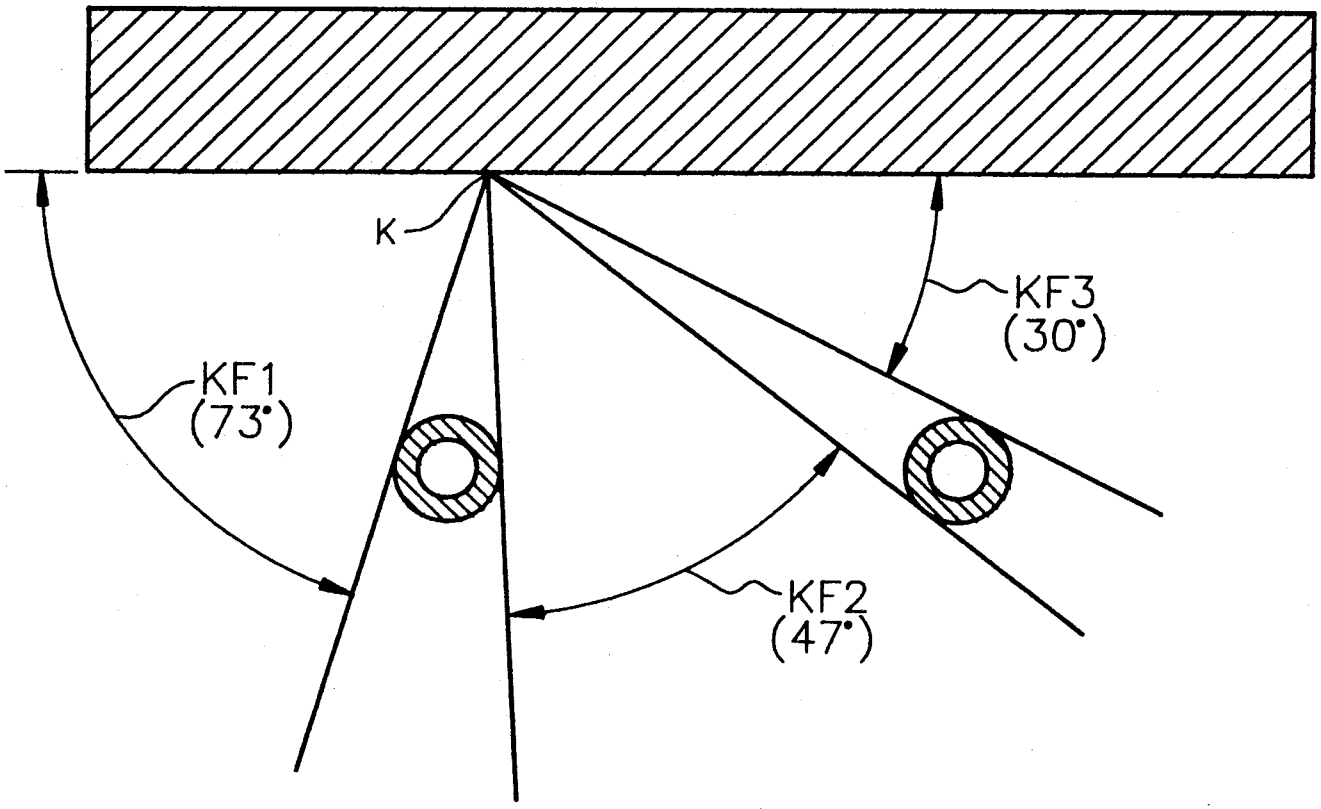
FIG. 4 is a diagram illustrating the improved heat transfer effects of the improved skidrail in accordance with the present invention.

First and foremost, the increased distance between (product) steel slab and the skidrail provides a greatly increased view of the hot furnace by the steel slab and subsequent improved heating of the steel. This relationship is illustrated by geometric inspection of FIGS. 3 and 4. FIGS. 3 and 4 show the subtended radiation viewangles from point "J" and "K" on the slab bottom surface which are visible to the heating effects of the hot furnace environment below. For comparison purposes, FIG. 3 shows a typical slab and supporting skidrail configuration generally found in slab reheat furnaces throughout the steel heating industry. FIG. 4 illustrates a similar slab/skidrail arrangement with the notably greater elevation difference of the skidrails with respect to the bottom slab surface. FIG. 4 shows the arrangement which is possible through the use of the cooling fluid circulation in the elevated button assembly of the present invention.

For a given point on the bottom slab surface, the heating by radiation from the hot furnace gases and enclosure is governed by the radiation viewfactor or portion of the hot furnace which each such point "sees" and is not blocked by interfering obstructions (such as other skidrails). For point "J" in FIG. 3, the viewfactor consists of three separate viewangles shown as JF1, JF2 and JF3 measuring approximately 44°, 63° and 7°, respectively, for a combined sum of 114°. This sum of 114 degrees represents sixty-three percent (63%) of the maximum possible viewangle of 180°. The remaining thirty-seven percent (37%) or sixty-six degrees (66°) being blocked by the presence of the two typical skidrails shown.

FIG. 4 demonstrates the increased viewangle radiation viewfactor and ensuing additional slab heating made possible by the separating of the skidrail position from the slab bottom surface. Corresponding viewfactors KF1, KF2, and KF3 are shown for an identical point "K" on the bottom slab surface. In this case, the viewangles measure "approximately" 73°, 47°, and 30°, respectively, for a sum of 150°. This elevated configuration, shown in FIG. 4, represents a markedly increased viewangle to some eighty-three percent (83%) of the available maximum of 180° and a significant additional viewangle when compared with the traditionally skidrail arrangement of FIG. 3. The increased/additional (slab to furnace) viewangle and radiation viewfactor achieved with the improved skidrail design of FIG. 4 has the natural and desired consequence of increased or additional steel slab heating within the furnace in accordance with the Stephan-Boltzman law mentioned above.

In addition, similar viewangle determinations for any other point on the slab bottom surface also produces higher viewangles and greater (slab-to-furnace) radiation viewfactors for the improved skidrail configuration as shown in FIG. 4.

As described above, it can be seen that the present invention demonstrates enhanced slab heating and improved thermal performance benefits by the employment of the improved skidrail design of the present invention. It should be noted that the technique of elevating skid buttons has been overlooked by reheat furnace designers and engineers for many years. Ideal conditions for virtually any radiant or convective furnace and heating process require "levitation" of the reheated product of the furnace to allow maximum and efficient heat transfer by heating the product from all sides. Traditional reheat furnace designs achieve a practical compromise by supporting the massive steel product load on a structural grid of water-cooled skidpipes and support posts. This conventional design provides complete radiation/convection heating to the top slab surface while the skid support system underneath the slab is built as prudently as possible to allow the greatest amount of radiation and furnace heat to reach the bottom slab surface.

Principally, the (product) steel slabs must be adequately supported and conveyed through these furnaces. A temperature and wear resistant contact surface construction is required for the skid support system. Within the realm of industrial economic reality, exhaustive trials and efforts with various ceramic and exotic metal alloys have recently yielded operational designs of slab support/wear surfaces, or "buttons" as they are known in the industry, with effective heights of elevations above the skidrail limited to approximately three to four inches.

Based on present knowledge, it is reasonable to conclude that the use of the "close proximity" skid designs compromise increased heating efficiencies for the sake of perceived practical, physical and material considerations. However, the development of the present invention was realized through the use of intensive radiation and heat transfer investigation of elevated skid button designs. The improved skidrail design accomplishes superior slab heating and improved furnace performance. The improved skidrail design of the present invention employs conventional wear surface/button materials at the contact/interface surface utilizing reasonable industry proven metal material configurations and thicknesses (typically two or three inches of high temperature cobalt base heat alloy). In contrast with traditional designs, these elevated wear surface buttons are located on elevated and separated water cooled posts to ensure adequate individual cooling to each elevated button. The present invention is thus able to accomplish what has not been accomplished in the prior art, that is, the ability to elevate the skid buttons for the purpose of improving the heating characteristics of the furnace operation.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A skidrail system for a walking-beam reheat furnace comprising:

a plurality of horizontal skidrails extending longitudinally inside and supported above a floor of the reheat furnace, said skidrails extending in a direction of travel of a product through the furnace;

a tubular pipe means extending vertically upwardly from said skidrails, said pipe means affixed to a top surface of said skidrails, said pipe means having a surface for directly supporting a product thereon, said skidrails positioned inside the furnace so as to be in direct radiant thermal interaction with the product supported on said surface of said piper means; and fluid circulation means contained within said pipe means, said fluid circulation means for delivering a fluid in heat exchange relationship with said pipe means.

2. The skidrail system of claim 1, each of said plurality of skidrails comprising a tubular member extending through the reheat furnace, said tubular member having a fluid passageway therein for the passage of a cooling fluid.

3. The skidrail system of claim 2, said pipe means rigidly affixed to said tubular member, said pipe means extending vertically upwardly therefrom.

4. The skidrail system of claim 3, said fluid circulation means in fluid communication with said fluid pathway of said tubular member such that said cooling fluid passes in heat exchange relationship with said pipe means.

5. The skidrail system of claim 4, said tubular member comprising:

a supply pipe positioned within said fluid pathway, said fluid circulation means comprising an extender pipe cooling tube extending interior of said pipe means, said extender pipe cooling tube in fluid communication with said supply pipe, said supply pipe for delivering said cooling fluid to said extender pipe cooling tube.

6. The skidrail system of claim 5, said fluid circulation means further comprising:

an annular passageway disposed between said extender pipe cooling tube and said pipe means, said extender pipe cooling tube opening within said pipe means so as to deliver said cooling fluid into said annular passageway.

7. The skidrail system of claim 1, said pipe means comprising:

a pipe member affixed to at least one of said skidrails; and a cap fastened to an end of said pipe member opposite said skidrail, said cap for closing an interior of said pipe member.

8. The skidrail system of claim 7, further comprising:

a skid button fastened to said pipe means, said skid button extending above said cap, said skid button of a heat resistive material for supporting the product thereon.

9. The skidrail system of claim 8, further comprising:

an insulation sleeve extending around an exterior of said pipe means, said insulation sleeve of a heat resistive material.

10. The skidrail system of claim 8, said pipe member having a length of greater than four inches, said cap positioned in fluid-tight relationship to an end of said pipe member, said skid button covering said cap.

11. The skidrail system of claim 1, said pipe means being skewed along said plurality of skidrails such that said surface for supporting the product is in contact with different areas on a surface of said product.

12. An improved skidrail assembly for a skid system of a walking-beam reheat furnace comprising:

a tubular pipe member extending transversely upwardly from and above a horizontal skidrail of the skid system, said horizontal skidrail supported above a floor of a furnace, said horizontal skidrail extending through the furnace in a direction of travel of a product through the furnace;

a skid button fastened to a top of said pipe member opposite said horizontal skidrail, said skid button for supporting a product thereon, said horizontal skidrail positioned inside the furnace so as to be in unobstructed radiant thermal interaction with a product supported upon a top surface of said skid button; and a fluid circulation means within said pipe member for passing a fluid in heat exchange relationship with said pipe member, said skid button sealing the top of said pipe member so as to contain said fluid within said pipe member.

13. The skidrail assembly of claim 12, said pipe member having a length of greater than four inches.

14. The skidrail assembly of claim 12, said skid button comprising:

a cap fastened in fluid-tight relationship to the top of said pipe member opposite said horizontal skidrail.

15. The skidrail assembly of claim 14, said skid button comprised of a heat resistive material, said skid button covering said cap.

16. The skidrail assembly of claim 12, further comprising:

an insulation sleeve extending around an exterior of said pipe member, said insulation sleeve of a heat resistive material.

17. The skidrail assembly of claim 12, further comprising:

a fluid supply interconnected to said fluid circulation means, said fluid supply containing a heat exchange fluid for delivery to said fluid circulation means.

18. A skidrail system for a walking-beam reheat furnace comprising:

a first skidrail extending horizontally and longitudinally within said reheat furnace and supported above a floor of said reheat furnace;

a second skidrail extending horizontally and longitudinally within said reheat furnace and supported above a floor of said reheat furnace, said second skidrail having at least a portion in skewed relationship to said first skidrail;

a plurality of tubular pipe members extending vertically upwardly above and from said first and second skidrails, said pipe members having an interior in fluid communication with an interior of said first and second skidrails; and a skid button positioned on an end of each of said pipe members opposite said first and second skidrails, said skid button for supporting a product directly thereon, said first and second skidrails positioned in proximity to said skid button so as to be in direct radiant thermal interaction with a product supported on said skid button.

19. The skidrail system of claim 18, further comprising:

fluid circulation means positioned in said first and second skidrails and said plurality of pipe members, said fluid circulation means for delivering a cooling fluid in heat exchange relationship with said pipe members.

20. The skidrail system of claim 18, said skid button supported at least four inches above said first and second skidrails.

* * * * *